US006136052A

United States Patent [19]

Daly

[11] Patent Number: 6,136,052

[45] **Date of Patent: *Oct. 24, 2000**

[54] FUEL ADDITIVES AND FUEL COMPOSITIONS CONTAINING SAID FUEL ADDITIVE

[75] Inventor: Daniel T. Daly, Solon, Ohio

[73] Assignee: The Lubrizol Corporation, Wickliffe, Ohio

[ * ] Notice: This patent is subject to a terminal disclaimer.

[21] Appl. No.: 09/248,463

[22] Filed: Feb. 11, 1999

Related U.S. Application Data

[63] Continuation-in-part of application No. 08/857,744, May 16, 1997, Pat. No. 5,873,917.

[51] Int. Cl.[7] ..... C10L 1/18; C10L 1/22

[52] U.S. Cl. ..... 44/443; 44/450; 44/412

[58] Field of Search ..... 44/443, 412, 450

[56] References Cited

U.S. PATENT DOCUMENTS 5,873,917 2/1999 Daly ..... 44/443

*Primary Examiner*—Margaret Medley
*Attorney, Agent, or Firm*—Michael F. Esposito; David M. Shold

[57] ABSTRACT

The present invention is directed to a fuel additive composition comprising at least two components:

(A) a polyether alcohol of the formula

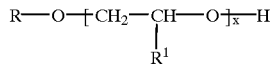

(A-1)

wherein in formula (A-1), R is hydrogen or a hydrocarbyl group of 1 to about 30 carbon atoms; $R^1$ is hydrogen or a hydrocarbyl group of 1 to 5 carbon atoms or mixtures thereof; and x is a number from about 4 to about 40.

(B) a hydrocarbylphenol having 1–3 hydrocarbyl groups such that the total weight average molecular weight of the hydrocarbyl groups is about 250 to about 6000.

In one embodiment the composition further comprises (C) a nitrogen-containing dispersant.

The composition is useful as a fuel additive for reducing intake valve deposits and advantageously, does not contribute to an increase in combustion chamber deposits in port fuel injected internal combustion engines. The invention also relates to concentrates and fuel compositions containing the foregoing fuel additive composition and to a method for fueling an internal combustion engine.

24 Claims, No Drawings

FUEL ADDITIVES AND FUEL COMPOSITIONS CONTAINING SAID FUEL ADDITIVE

CROSS REFERENCE TO RELATED APPLICATIONS

This is a continuation-in-part of application Ser. No. 08/857,744 filed May 16, 1997, now U.S. Pat. No. 5,873,917.

BACKGROUND OF THE INVENTION

1. Field of the Invention

The present invention relates to fuel additives and gasoline compositions effective for reducing intake valve deposits which do not contribute to increased deposit formation in port fuel injected engines.

2. Description of the Related Art

It is well known to those skilled in the art that internal combustion engines form deposits on the surface of engine components, such as carburetor ports, throttle bodies, fuel injectors, intake ports, and intake valves, due to the oxidation and polymerization of hydrocarbon fuel. Deposits also form in the combustion chamber of an internal combustion engine as a result of incomplete combustion of the mixture of air, fuel, and oil. These deposits, even when present in relatively minor amounts, often cause noticeable driving problems, such as stalling and poor acceleration. Moreover, engine deposits can significantly increase an automobile's fuel consumption and production of exhaust pollutants. Specifically, when the gasoline used in a given engine is of a constant octane number, the power output decreases when deposits are formed. In order to maintain the power output at a predetermined desired level, it then becomes necessary to increase the octane number of the fuel over the course of time. This Octane Requirement Increase (ORI) is undesirable. Therefore, the development of effective fuel detergents or deposit control additives to prevent or control such deposits is of considerable importance, and numerous such materials are known in the art.

Two general classes of additives are commercially known. One class comprises hydrocarbyl-substituted amines such as those prepared by reacting olefins and olefin polymers with amines (including polyamines). Typical examples of this class are polybutenyl amines. Another class of additives comprises the polyetheramines. Usually, these are "single molecule" additives, incorporating both amine and polyether functionalities within the same molecule. A typical example is an urethane product comprising repeating butylene oxide units under the trade name "Techron™" marketed by Chevron.

In some cases, the polyetheramines are preferred as the oxygenation (from the polyether functionality) is thought to lower particulate matter and nitrogen oxide (NOx) emissions and combustion chamber deposits. In addition, polyetheramines require little or no additional fluidizer oil to pass certain industry mandated valve stick requirements, resulting in a more economical final package. Polyisobutenyl amines, on the other hand, do require the addition of fluidizer oil to pass valve stick requirements and in addition are perceived to cause higher combustion chamber deposits than the fuel alone.

Canadian patent 1021157, Kreuz et al., Nov. 22, 1977 discloses a motor fuel composition comprising a mixture of hydrocarbons in the gasoline boiling range containing a minor amount of high molecular weight aliphatic hydrocarbon substituted or alkylated phenol in which the aliphatic hydrocarbon radical has an average molecular weight in the range from about 500–3500. This composition is useful in the prevention or inhibition of the formation of intake valve and port deposits in a gasoline engine, and also in enhancing the performance of the fuel composition in an engine designed to operate at significantly higher operating temperatures with a minimum of decomposition and deposit formation in the manifold of the engine.

U.S. Pat. No. 3,901,665, Polss, Aug. 26, 1975 discloses that combinations of (A) polymers of $C_3$–$C_4$ olefins having a molecular weight in the range of about 400 to about 1400; and (B) polyoxyalkylene compounds of the formula

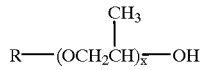

wherein R is an alkyl group of 1 to 20 carbon atoms and wherein x has an average value of 4 to 20; are effective as anti-icing additives, as carburetor detergents, and in some instances as intake valve deposit modifiers.

U.S. Pat. No. 5,006,130, Aiello et al., Apr. 9, 1991, discloses a fuel additive for reducing intake valve deposits in electronic port fuel injected engines, said additive comprising a mixture of (a) about 2.5 parts per million per weight (ppmw) or higher of basic nitrogen based on the fuel composition in the form of an oil soluble aliphatic alkylene polyamine containing at least one olefinic polymer chain, said polyamine having a molecular weight of about 600 to about 10,000, and (b) from about 75 ppmw to about 125 ppmw based on the fuel composition of certain oil-soluble olefinic polymers, poly(oxyalkylene) alcohol, glycol or polyol or mono or di-ether thereof, non aromatic oils or polyalphaolefins.

U.S. Pat. No. 2,807,525, Foreman, Sep. 24, 1957, discloses a fuel composition characterized by a relatively low tendency to form gum deposits in the intake system and valves of an internal combustion engine and a relatively low freezing point containing an additive comprising an oil-soluble monobutoxy poly-1,2-oxypropylene glycol having a viscosity of from about 200 to 1000 SUS at 100° F., and a water-miscible lower aliphatic hydrocarbon alcohol having from one to three carbon atoms in an amount within the range from 20% to 80% by volume to facilitate the solution of the polyoxyalkylene compound in the fuel and together with the polyoxyalkylene compound to reduce the freezing point of water present in the fuel.

U.S. Pat. No. 3,615,295, Manary, Oct. 26, 1971, discloses a fuel composition containing a small but effective amount of a polyalkoxylated alkylphenol of the general formula

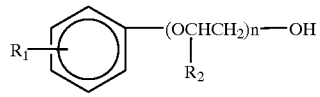

for reducing the hydrocarbon emission in the exhaust from an internal combustion engine.

U.S. Pat. No. 4,548,616, Sung et al., Oct. 22, 1985 discloses a fuel composition for reducing gasoline octane requirement, containing an additive, said additive comprising a poly(oxyethylene) poly(oxypropylene) poly (oxyethylene)polyol.

U.S. Pat. No. 4,877,416, Campbell, Oct. 31, 1989 discloses a synergistic fuel composition containing a hydrocarbyl-substituted amine or polyamine and a poly (oxyalkylene) monool, said composition providing for decrease in deposit formation correlated to Octane Requirement Increase (ORI).

U.S. Pat. No. 5,427,591, Cherpeck, Jun. 27, 1995 discloses a fuel additive of the formula:

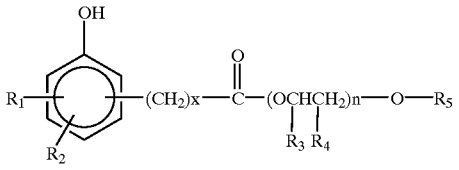

or a fuel-soluble salt thereof; wherein $R_1$ and $R_2$ are each independently hydrogen, hydroxy, lower alkyl having 1–6 carbon atoms, or lower alkoxy having 1–6 carbon atoms; $R_3$ and $R_4$ are each independently hydrogen or lower alkyl having 1 to 6 carbon atoms. These poly(oxyalkylene) hydroxyaromatic ethers were disclosed to be useful as fuel additives for the prevention and control of engine deposits.

U.S. Pat. No. 4,663,063, Davis, May 5, 1987, discloses a lubricant composition for use in two-cycle internal combustion engines containing an additive sufficient to control piston ring sticking and promote general engine cleanliness, said additive comprising:

(A) an alkylated phenol of the formula:

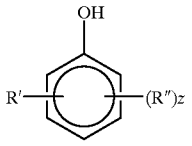

wherein R' may be located ortho or para to the hydroxyl group and is a hydrocarbon-based group containing about 30 to about 400 aliphatic carbon atoms, R" is a lower alkyl and z is 0 or 1; and (B) a polyalkylene polyamine of the general formula

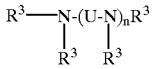

or a derivative of such a polyalkylene polyamine wherein U is an alkylene group of from about 2 to about 10 carbon atoms, each $R^3$ is independently selected from the group consisting of hydrogen and a hydrocarbon-based group containing 1–12 carbon atoms with the proviso that at least one R is a hydrogen atom, and n is a whole number of from 1 to about 10 wherein the weight ratio of (A):(B) is in the range of from abut 2:1 to about 400:1.

The present invention provides a novel deposit control fuel additive composition comprising an alkylphenol, a polyether alcohol, and optionally a nitrogen-containing dispersant that is shown to give lower deposits in the intake valve and combustion chamber.

SUMMARY OF THE INVENTION

The present invention relates to a composition comprising at least two components:

(A) a polyether alcohol of the formula

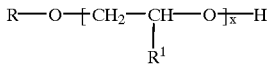

(A-1)

wherein in formula (A-1), R is hydrogen or a hydrocarbyl group of 1 to about 30 carbon atoms; $R^1$ is hydrogen or a hydrocarbyl group of 1 to 5 carbon atoms or mixtures thereof; and x is a number from about 4 to about 40.

(B) a hydrocarbylphenol having 1–3 hydrocarbyl groups such that the total weight average molecular weight of the hydrocarbyl groups is about 250 to about 6000.

In one embodiment the composition further comprises (C) a nitrogen-containing dispersant.

These compositions are useful as fuel additives for reducing intake valve deposits and advantageously, they do not contribute to an increase in combustion chamber deposits in port fuel injected internal combustion engines. The invention also relates to concentrates and fuel compositions containing the foregoing fuel additive compositions and to a method for fueling an internal combustion engine.

DETAILED DESCRIPTION OF THE INVENTION

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbylene substituent" or "hydrocarbylene group" is used to refer to a divalent hydrocarbyl group, such as ethylene ($—CH_2CH_2—$) or propylene group. An alkylene group is a limited example of a hydrocarbylene group without the presence of heteroatoms.

The Fuel Additive

The fuel additive composition of the present invention comprises at least two components: A) a polyether alcohol and B) a hydrocarbylphenol.

The Polyether Alcohol (A)

The first component of the additive of this invention comprises a polyether alcohol of the formula

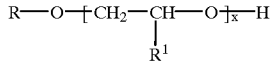

(A-1)

wherein in formula (A-1), R is a hydrocarbyl group of 1 to about 30 carbon atoms, and in one embodiment about 10 to about 20 carbon atoms, and in one embodiment about 12 to about 18 carbon atoms; $R^1$ is hydrogen or a hydrocarbyl group of 1 to 5 carbon atoms, and in one embodiment 1 to 2 carbon atoms; or mixtures thereof; and x is a number from 4 to 40, and in one embodiment about 10 to 30 carbon atoms, and in one embodiment about 10 to 20 carbon atoms.

The polyether alcohols are monohydroxy compounds, often termed monohydroxy polyethers, or "capped" poly (oxyalkylene) glycols and are to be distinguished from the poly(oxyalkylene) glycols (diols), or polyols, which are not hydrocarbyl-terminated, i.e., not capped. The polyether alcohols are produced by the addition of lower alkylene oxides, such as ethylene oxide, propylene oxide, the butylene oxides, or the pentylene oxides to the hydroxy compound ROH under polymerization conditions, wherein R is the hydrocarbyl group which caps the poly(oxyalkylene) chain. Methods of production and properties of these polymers are disclosed in U.S. Pat. Nos. 2,841,479 and 2,782,240 and Kirk-Othmer's "Encyclopedia of Chemical Technology", 2nd Ed., Volume 19, p. 507. In the polymerization reaction a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as mixture of propylene and butylene oxides. Block copolymers of oxyalkylene units also provide satisfactory poly(oxyalkylene) polymers for the practice of the present invention. Random polymers are more easily prepared when the reactivities of the alkylene oxides are relatively equal. In certain cases, when ethylene oxide is copolymerized with other oxides, the higher reaction rate of ethylene oxide makes the preparation of random copolymers difficult. In either case, block copolymers can be prepared. Block copolymers can be prepared by contacting the hydroxyl-containing compound with first one alkylene oxide, then the others in any order, or repetitively, under polymerization conditions. For example, ethylene oxide can be polymerized first using a monohydroxy alcohol initiator to form a poly (oxyethylene) alcohol, and then propylene oxide could be polymerized onto the poly(oxyethylene) alcohol.

In general, the poly(oxyalkylene) polymers are mixtures of compounds that differ in polymer chain length. However, their properties closely approximate those of the polymer represented by the average composition and the polydispersity, which is the ratio of the weight average molecular weight to the number average molecular weight of the polymer. The number of oxyalkylene units in the polymer will vary from about 4 to about 40 units, and in one embodiment from about 10 to about 30 units, and in one embodiment about 10 to about 20 units.

In the present invention, the oxyalkylene moiety can comprise a mixture of ethylene oxide, propylene oxide, and butylene oxide repeating units; however no more than 10% of repeat units can be ethylene oxide. Another requirement of the polyether alcohol of this invention is that it must be soluble in gasoline, i.e., the polyether alcohol will be homogeneously miscible up to at least about 1000 ppm, preferably at least about 10,000 ppm based on the total weight of gasoline, at 20° C.

A preferred polyether alcohol of this invention is a polypropylene oxide initiated by a $C_{13}$ monohydroxy alcohol. It has a weight average molecular weight of about 900. It has the tradename "Emkarox™ AF-20", and is manufactured by ICI.

The Hydrocarbylphenol (B)

The second component of the additive of this invention comprises a hydrocarbylphenol having 1–3 hydrocarbyl groups such that the total weight average molecular weight of the hydrocarbyl groups is about 250 to about 6000. It should be noted that the term "phenol" as used herein to describe hydrocarbylphenol refers to hydroxy aromatic hydrocarbons and not only to hydroxybenzene.

The hydrocarbylphenol of this invention can include a single aromatic nucleus, such as a benzene nucleus, as well as polynuclear aromatic moieties. Such polynuclear moieties can be of the fused type; that is wherein at least two aromatic nuclei are fused at two points to another nucleus such as found in naphthalene and anthracene. The preferred hydrocarbylphenol of this invention is represented by the formula

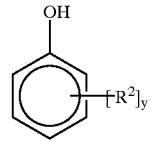

wherein $R^2$ is a hydrocarbyl group and y is 1 to 3; provided that if y is 1, $R_2$ has a molecular weight of about 500 to about 1500; and if y is 2 or 3, then the total molecular weight of all $R^2$ groups is about 500–1500.

Phenol compounds useful as starting materials for preparing the above compounds include mononuclear monohydroxy aromatic hydrocarbons. Specific compounds within these classes include phenol, xylenol, cresol, and other monohydric phenols. Corresponding compounds having low molecular weight alkyl radicals, such as $C_1$ to $C_4$-alkyl phenols, can also be used as the phenol component. The specific compound, phenol ($C_6H_5OH$) is the preferred hydroxy aromatic compound for the reaction.

The hydrocarbyl group(s) $R^2$ attached to the aromatic ring is derived from any natural or synthetic aliphatic hydrocarbon such that the total molecular weight of all $R^2$ is in the range of about 500 to about 1500. Thus, this material can be obtained from mineral oils or other natural hydrocarbons or organic materials. It can also be prepared synthetically. For example, polymers, copolymers or the corresponding hydrogenated polymers or copolymers obtained from the polymerization of olefinic hydrocarbons, such as $C_2$ to $C_6$ olefins, having the prescribed molecular weight are useful. Ethylene, propylene, 1,2-butylene, isobutylene and 2,3-butylene are particularly useful for preparing a suitable aliphatic hydrocarbon. A preferred source of the group $R^2$ is poly(isobutene)s obtained by polymerization of a $C_4$ refinery stream having a butene content of about 35 to about 75 weight percent and isobutene content of about 30 to about 60 weight percent, in the presence of a Lewis acid catalyst such as aluminum trichloride or boron trifluoride. These polybutenes typically contain predominantly (greater than 80% of total repeating units) isobutene repeating units of the configuration

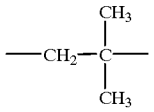

These polybutenes are typically monoolefinic, that is, they contain but one olefinic group per molecule said olefinic group being present as an end group.

In one embodiment, the monoolefinic end groups are vinylidene groups, i.e., groups of the formula

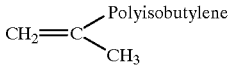

although the polybutenes may also comprise other olefinic configurations.

In one embodiment, the polybutene comprises about at least 50%, more preferably at least 80% vinylidene end groups. Such materials and methods for preparing them are described in U.S. Pat. Nos. 5,286,823 and 5,408,018. They are commercially available for example under the tradenames Ultravis™ (BP Chemicals) and Glissopal™ (BASF).

Numerous methods are known for preparing the hydrocarbyl substituted phenols described above and any of these are considered suitable for preparing the alkylphenol component of this invention. Techniques for alkylating phenols are well known to those skilled in the art. See, for example, the discussion in the article entitled "Alkylation of Phenols" in Kirk-Othmer "Encyclopedia of Chemical Technology", Second Edition, Vol. 1, pages 894–895, Interscience Publishers, a division of John Wiley and company, N.Y., 1963. One particularly suitable technique is the Friedel-crafts reaction, wherein an olefin (e.g., a polymer containing an olefinic bond, or halogenated or hydrohalogenated analog thereof), is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Other equally appropriate and convenient techniques for attaching the hydrocarbyl group $R^2$ to the aromatic ring will occur readily to those skilled in the art.

Other Optional Components

In one embodiment, the additive composition of the present invention further comprises (C) a nitrogen-containing dispersant.

One class of nitrogen-containing dispersants is a hydrocarbyl-substituted amine. These hydrocarbyl substituted amines are well known those skilled in the art. These amines and the methods of making them are disclosed in U.S. Pat. Nos. 3,275,554; 3,438,757; 3,454,555; 3,565,804; 3,755,433; and 3,822,289. Typically, hydrocarbyl substituted amines are prepared by reacting olefins and olefin polymers, including polyalkenes and halogenated derivatives thereof, with amines (mono- or polyamines). Examples of hydrocarbyl substituted amines include poly(propylene) amine; polybutene amine; N-(2-hydroxypropyl)N-polybutene amine; N-polybutenemorpholine; N-poly(butene)ethylenediamine; N-poly(propylene) trimethylenediamine; N-poly(butene)diethylenetriamine; N',N'-poly(butene)tetraethylenepentamine; NN-dimethyl-N'poly(propylene)-1,3-propylnediamine and the like. The weight average molecular weight of the hydrocarbyl amines will typically range from about 500 to about 3000, the most preferred range being 1000 to 1500.

Another class of nitrogen-containing dispersants is Mannich dispersants. Mannich dispersants are generally formed by the reaction of at least one aldehyde, such as formaldehyde and paraformaldehyde, an amine, and at least one alkyl substituted hydroxyaromatic compound. The amounts of the reagents are such that the molar ratio of hydroxyaromatic compound to formaldehyde to amine typically is in the range from about (1:1:1) to about (1:3:3). The hydroxyaromatic compound is generally an alkyl substituted hydroxyaromatic compound, including phenols. The hydroxyaromatic compounds are those substituted with at least one, and preferably not more than two, aliphatic or alicyclic groups having from about 6 to about 400, or from about 30 to about 300, or from about 50 to about 200 carbon atoms. These groups can be derived from one or more olefins or polyalkenes. In one embodiment, the hydroxyaromatic compound is a phenol substituted with an aliphatic or alicyclic hydrocarbon-based group having a weight average molecular weight ($M_w$) of about 420 to about 2000. Mannich dispersants are described in the following U.S. Pat. Nos. 3,980,569; 3,877,899; and 4,454,059.

The Mannich dispersants can be post treated with such reagents as urea, thiourea, carbon disulfide, aldehydes, ketone, carboxylic acids, hydrocarbon-substituted succinic anhydrides, nitriles, epoxides, boron compounds, phosphorus compounds and the like to give additional dispersants. Examples of this type of post treated Mannich dispersants can be found in the following U.S. Pat. Nos. 3,639,242; 3,649,229; 3,649,659; 3,658,836; 3,697,574; 3,702,757; 3,703,536; 3,704,308; and 3,708,422.

Another class of nitrogen-containing dispersants are acylated nitrogen containing compounds, which include amine salts, amides, imides, amidines, amidic acids, amidic salts and imidazolines as well as mixtures thereof. To prepare the acylated nitrogen-containing compounds from the acylating agents and the amino compounds, one or more acylating agents and one or more amino compounds can be heated, optionally in the presence of a normally liquid, substantially inert organic liquid solvent/diluent, at temperatures in the range of about 80° C. up to the decomposition point of either the reactants or the carboxylic derivative but normally at temperatures in the range of about 100° C. up to about 300° C., provided 300° C. does not exceed the decomposition point. Temperatures of about 125° C. to about 250° C. are normally used.

Many patents have described useful acylated nitrogen-containing compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763; and 4,234,435. A typical acylated nitrogen-containing compound of this class is that made by reacting a poly(isobutene)-substituted succinic acid acylating agent (e.g., anhydride, acid, ester, etc.) wherein the poly (isobutene) substituent has about 50 to about 400 carbon atoms, with a mixture of ethylenepolyamines having about 3 to about 7 amino nitrogen atoms per ethylenepolyamine and 1 to about 6 ethylene units made from condensation of ammonia with ethylene chloride.

Also included among acylated nitrogen-containing compounds are amide products resulting from the reaction of a lactone with amines. The lactone is the result of reaction of an alkylphenol with a carboxylic acid. In a preferred embodiment, the alkylphenol will be a polyisobutenylphenol wherein the molecular weight of the polyisobutenyl group ranges from about 300 to about 2000; the carboxylic acid is glyoxylic acid, and the amine is a polyamine. These amide products are disclosed in U.S. Pat. No. 5,336,278.

Another example of amide products resulting from reaction of lactone with amines involve compositions disclosed in European Patent Publication EP 823 471. These compositions include products made by the process of reacting an olefinic compound (such as a polyolefin), with at least one omegaoxoalkanoic acid (such as glyoxylic acid), and an aldehyde (such as formaldehyde) or ketone, followed by reaction with an amine.

Similar to the above Application is European Patent Publication EP 802 256. This Application discloses the process of reacting an olefinic compound (such as polyolefin), with at least one omega-oxoalkanoic acid (such as glyoxylic acid), followed by reaction with an amine. Specifically, this Application discloses a process comprising first reacting, optionally in the presence of an acidic catalyst selected from the group consisting of organic sulfonic acids, heteropolyacids, Lewis acids, and mineral acids, (A) at least one olefinic compound containing at least one group of the formula (I)

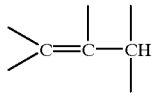

and (B) at least one carboxylic reactant selected from the group consisting of compounds of the formula $$R^3C(O)(R^4)_nC(O)OR^5 \quad \text{(IV)}$$

and compounds of the formula (V)

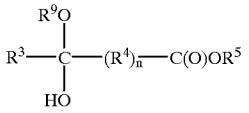

wherein each of $R^3$, $R^5$ and $R^9$ is independently H or a hydrocarbyl group, $R^4$ is a divalent hydrocarbylene group, and n is 0 or 1; wherein (A) and (B) are reacted in amounts ranging from more than 1.5 moles (B) per mole of (A) up to about 3 moles (B) per equivalent of (A); then reacting the product formed thereby with from about 0.5 equivalents up to about 2 moles, per mole of (B) of at least one of (C) ammonia or a hydrazine or an amine.

Also included are acylated amine compositions disclosed European Patent Publication EP 802 255 U.S. Pat. No. 081,632,570 Apr. 15, 1986. This application discloses a composition comprising a compound of the formula (I)

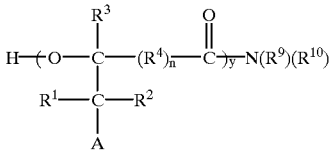

wherein each of $R^1$ and $R^2$ is H or a hydrocarbon based group, $R^3$ is H or hydrocarbyl;

$R^4$ is a divalent hydrocarbylene group;

n=0 or 1;

y is an integer ranging from 1 to about 200;

A is a hydrocarbyl group or a hydroxy-substituted hydrocarbyl group; and each of $R^9$ and $R^{10}$ is independently H, alkoxyhydrocarbyl, hydroxyhydrocarbyl, hydrocarbyl, aminohydrocarbyl, N-alkoxyalkyl- or hydroxyalkyl-substituted aminohydrocarbyl, or a group of the formula $$-(Y)_a-R^{11}-B,$$

wherein each Y is a group of the formula $$R^{11}-N(R^{12})-$$

or $$R^{11}-O-,$$

each $R^{11}$ is a divalent hydrocarbyl group, $R^{12}$ is as defined above for $R^9$ and $R^{10}$, and B is H, hydrocarbyl, amino, hydroxyhydrocarbyl, an amide group, an amide-containing group, an acylamino group, an imide group, or an imide-containing group, and a is 0 or a number ranging from 1 to about 100, provided that no more than three $R^9$, $R^{10}$, and $R^{12}$ contain amide groups, imide-containing groups, acylamino groups or amide-containing groups; or $R^9$ and $R^{10}$ taken together with the adjacent N constitute a nitrogen-containing heterocyclic group, optionally further containing one or more additional heteroatoms selected from the group consisting of N, O and S; or one of $R^9$ and $R^{10}$ taken together with the adjacent N constitute a N—N group.

Also included among acylated nitrogen containing compounds are oxazolines and imidazolines as described in U.S. Pat. No. 5,560,755.

The molecular weight of the acylated nitrogen-containing dispersant will typically range from about 500 to about 20,000, more preferably from about 800 to about 10,000 and most preferably from about 1000 to about 3000.

Another type of nitrogen-containing dispersants is nitrogen-containing carboxylic ester dispersant compositions. These are known in the art, and the preparation of a number of these derivatives is described in, for example, U.S. Pat. Nos. 3,957,854 and 4,234,435. They are prepared by reacting carboxylic esters with at least one amine and preferably at least one polyamine. The carboxylic esters and methods of making the same are known in the art and are disclosed in U.S. Pat. Nos. 3,219,666, 3,381,022 3,522,179 and 4,234,435.

Also included among nitrogen-containing dispersants are aminophenols. Typically, such materials are prepared by reducing hydrocarbyl substituted nitrophenols to the corresponding aminophenol. Useful aminophenols include those described in U.S. Pat. Nos. 4,320,000 and 4,320,021. Aminophenols and methods for preparing them are also described in U.S. Pat. Nos. 4,100,082; 4,200,545; 4,379,065; and 4,425,138. It should be noted that the term "phenol" as used here in the context of aminophenols is not intended to limit the compounds referred to in that manner as being only monofunctional hydroxyaromatic derivatives but is also intended to include aromatic hydroxy compounds with more than one hydroxy functionality, such as catechols and others as described in the foregoing patents.

Also included among useful nitrogen-containing dispersants are aminocarbamate dispersants such as those described in U.S. Pat. No. 4,288,612.

Another class of nitrogen-containing dispersants are polyetheramines (polyoxyalkyleneamines). They contain primary amino groups attached to the terminus of a polyether backbone. The polyether backbone can be based on propylene oxide, ethylene oxide, butylene oxide, or mixtures of these. The most preferred are propylene oxide or butylene oxide or mixture thereof to impart good fuel solubility. The polyetheramines can be monoamines, diamines or triamines. The mono- and di-polyetheramines can be represented by the structure $$[H_2N—R^3—(OCH(R)CH_2)_nO]_yR^4$$

wherein each n is a number from about 4 to about 50; R is selected from the group consisting of hydrogen, hydrocarbyl group of 1 to about 16 carbon atoms, and mixtures thereof; $R^3$ is a hydrocarbylene or aminoalkylene group (such as $—CH_2)_3NH(CH_2)_3—$) of 2 to 6 carbon atoms; y is 1 or 2; and $R^4$ is a hydrocarbyl group having a valence of y and containing 1 to about 30 carbon atoms when y is 1 and 1 to about 18 carbon atoms when y is 2. Examples of commercially available polyetheramines are those under the tradename Jeffamines™ available from Huntsman Chemical company. The molecular weight of the polyetheramines will typically range from about 500 to about 3000.

The Concentrate

The fuel additive compositions of this invention can be added directly to a fuel, or they can be diluted with a substantially inert, normally liquid organic diluent such as naphtha, benzene, toluene, xylene or a normally liquid fuel as described above, to form an additive concentrate. These concentrates generally contain from about 20% to about 90% by weight of the fuel additive of this invention and may contain, in addition one or more other conventional additives known in the art or described hereinbelow.

The Fuel Composition

The compositions of the present invention comprise a major portion of a liquid fuel boiling in the gasoline boiling range as well as a portion of the additive composition described hereinabove (the composition comprising components (A), (B) and optionally component (C), provided that no more than 10 mole % of $R^1$ in the polyether alcohol of the formula (A-1) is hydrogen, and said polyether alcohol is soluble in gasoline. The term "major portion" indicates that preferably at least 95% or more preferably at least 99% of the fuel composition will comprise a liquid fuel boiling in the gasoline range.

The Liquid Fuel

The liquid fuels of this invention are well known to those skilled in the art and usually contain a major portion of a normally liquid fuel such as hydrocarbonaceous petroleum distillate fuel (e.g., motor gasoline as defined by ASTM Specifications D-439-89 and fuels containing non-hydrocarbonaceous materials such as alcohols, ethers, organo-nitro compounds and the like (e.g., methanol, ethanol, diethyl ether, methyl ethyl ether, nitromethane) are also within the scope of this invention.

Oxygen containing molecules (oxygenates) are compounds covering a range of alcohol and ether type compounds. They have been recognized as means for increasing octane value of a base fuel. They have also been used as the sole fuel component, but more often as a supplemental fuel used together with, for example, gasoline, to form the well-known "gasohol" blend fuels. Oxygenated fuel (i.e. fuels containing oxygen-containing molecules) are described in ASTM D-4814-91. The oxygenated fuel of this invention will typically comprise up to 25% by weight of one or more oxygen-containing molecules. In one embodiment the oxygenated fuel comprises 5 to 15% by weight of one or more oxygen-containing molecules. In another embodiment, the oxygenated fuel comprises 1 to 5% by weight of one or more oxygen-containing molecules.

Methanol and ethanol are the most commonly used oxygen-containing molecules. Other oxygen-containing molecules, such as ethers, for example methyl-t-butyl ether, are more often used as octane number enhancers for gasoline.

Particularly preferred liquid fuels are gasoline, that is, a mixture of hydrocarbons having an ASTM boiling point of about 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

The fuel compositions of the present invention can contain other additives which are well known to those of skill in the art. These can include anti-knock agents such as tetra-alkyl lead compounds, lead scavengers such as haloalkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizer oils, metal deactivators, demulsifiers, and anti-icing agents. The fuel compositions of this invention can be lead-containing or lead-free fuels. Preferred are lead-free fuels.

Relative Amounts of Components and Treat Levels of Fuel Additive

The additive composition of the present invention can be present in any "intake valve deposit reducing amount". That is the additive composition, including any of the individual components of the composition may be used in any amount sufficient to prevent or reduce the formation of intake valve deposits. In one embodiment, the additive composition including any of the individual components of the additive composition may be present in any amount sufficient to prevent or reduce the formation of combustion chamber deposits or to remove them where they have formed.

The relative amounts of components (A) and (B) or (A), (B) and (C) can be any amount sufficient to reduce or prevent intake valve and/or combustion chamber deposits.

In one embodiment, the weight ratio of the polyether alcohol (A) to the hydrocarbylphenol (B) ranges from about 40:1 to about 1:40, and in one embodiment about 20:1 to about 1:20 and in one embodiment about 10:1 to about 1:10.

Treating levels of the additives used in this invention are often described in terms of pounds per thousand barrels (PTB) of fuel. The PTB values may be multiplied by four to convert the number to parts per million (by weight) (PPM).

The fuel compositions of this invention contain from about 50 to about 800 PPM (12.5 to 200 PTB) of fuel additive, and in one embodiment from about 100 to about 600 PPM (25 to 125 PTB), and in one embodiment from about 200 to about 400 PPM (50 to 100 PTB) of fuel additive based on the total fuel composition weight. The nitrogen-containing dispersant if present will be present at a level of about 10 to about 200 PPM (2.5 to 50 PTB), and in one embodiment, from about 20 to about 100 PPM (5 to 25 PTB) based on the total fuel composition weight.

EXAMPLES

Examples of several compositions embodying the present invention are shown in Table 1.

TABLE 1

Test Results of Gasoline[1] + Deposit Control Additive

| Example | Hydrocarbyl-phenol[2] (PPM) | Polyether fluidizer[3] (PPM) | Honda[4] Deposits (mg) | IVD[5] (mg) | CCD[6] (mg) |
|---|---|---|---|---|---|
| 1[7] (Control) | 0 | 0 | 126 | 805 | 1339 |
| 2[8] | 200 | 0 | 5 | nd | nd |
| 3 | 100 | 300 | 15 | 115 | nd |
| 4 | 150 | 50 | 9 | 372 | nd |
| 5 | 100 | 100 | 20 | nd | nd |
| 6[9] | 120 | 120 | nd | 35 | 1498 |

nd = not determined
[1]Base fuel: BP 2000006-6
[2]Polyisobutenylphenol prepared by alkylating phenol with polyisobutene (MW)
[3]Emkarox AF-20--Polypropylene oxide monool
[4]Honda 2-cylinder generator
[5]Intake valve deposits from 2.3 L Ford
[6]Combustion chamber deposits from 2.3 L Ford
[7]Control--Base fuel only
[8]Reference
[9]Also contains 80 PPM (20 PTB) of nitrogen-containing dispersant: 40 PPM (10 PTB) of polybutenyl amine based detergent + 40 PPM (10 PTB) of acylated amine dispersant Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising at least two components:

(A) a polyether alcohol of the formula

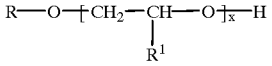

(A-1)

wherein in formula (A-1), R is hydrogen or a hydrocarbyl group of 1 to about 30 carbon atoms; $R^1$ is hydrogen or a hydrocarbyl group of 1 to 5 carbon atoms or mixtures thereof provided that no mor than 10 mole % of $R^1$ is hydrogen; and x is a number from about 4 to about 40.

(B) a hydrocarbylphenol having 1–3 hydrocarbyl groups such that the total weight average molecular weight of the hydrocarbyl groups is about 250 to about 6000 wherein the weight ratio of the polyether alcohol to the hydrocarbylphenol is about 3:1 to about 1:20.

2. The composition of claim 1 wherein in formula (A-1), R is a hydrocarbyl group of about 10 to about 20 carbon atoms.

3. The composition of claim 1 wherein in formula (A-1), $R^1$ is methyl, R is a hydrocarbyl group of about 12 to about 18 carbon atoms and x is a number from about 10 to about 20.

4. The composition of claim 1 wherein in formula (A-1), R is nonylphenyl.

5. The composition of claim 1 wherein component (B) is represented by the formula

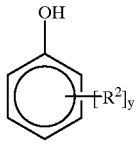

(B-1)

wherein in formula (B-1), $R^2$ is a hydrocarbyl group; and y is 1 to 3; provided that if y is 1, $R^2$ has a molecular weight of about 500 to about 1500; and if y is 2 or 3, then the total molecular weight of all $R^2$ groups is about 500 to about 1500.

6. The composition of claim 5 wherein y is 1 and $R^2$ is derived from a polyisobutene, said polyisobutene having at least one olefin end group.

7. The composition of claim 6 wherein at least 80% of the olefin end groups are of vinylidene structure.

8. A concentrate comprising about 10% to about 90% by weight of an organic diluent and the composition of claim 1.

9. The composition of claim 1 further comprising (C) a nitrogen-containing dispersant.

10. The composition of claim 1 wherein component (C) is selected from the group consisting of hydrocarbyl amines, acylated nitrogen-containing compounds, polyetheramines and mixtures thereof.

11. The composition of claim 10 wherein component (C) comprises at least one polybutene amine.

12. The composition of claim 11 wherein component (C) comprises a mixture of said polybutene amine and said acylated nitrogen-containing compound.

13. The composition of claim 10 wherein the number average molecular weight of said hydrocarbyl amine ranges from about 500 to 2000; the number average molecular weight of said acylated nitrogen-containing compound ranges from about 500 to about 20,000; and the number average molecular weight of said polyetheramine ranges from about 500 to about 3000.

14. A composition prepared by combining the ingredients of claim 1.

15. A composition prepared by combining the ingredients of claim 9.

16. A fuel composition comprising:

(I) a major portion of a liquid fuel boiling in the gasoline boiling range; and (II) an intake valve deposit reducing amount of about 50 ppm to about 800 ppm based on the weight of the fuel of an additive composition, said additive composition comprising:

(A) a polyether alcohol of the formula

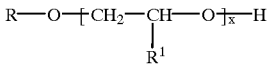

(A-1)

wherein in formula (A-1), R is hydrogen or a hydrocarbyl group of 1 to about 30 carbon atoms; $R^1$ is hydrogen or a hydrocarbyl group of 1 to 5 carbon atoms or mixtures thereof provided that no more than 10 mole % of $R^1$ is hydrogen, and said polyether alcohol is soluble in gasoline; and x is a number from about 4 to about 40; and (B) a hydrocarbylphenol having 1–3 hydrocarbyl groups such that the total weight average molecular weight of the hydrocarbyl groups is about 250 to about 6000 wherein the weight ratio of the polyether alcohol to the hydrocarbylphenol is about 3:1 to about 1:20.

17. A composition prepared by combining the ingredients of claim 16.

18. The composition of claim 16 wherein said liquid fuel is an oxygenated fuel which comprises about 5% to about 20% of one or more oxygen-containing molecules.

19. The composition of claim 16 wherein said liquid fuel is an oxygenated fuel which comprises about 1% to about 5% of one or more oxygen containing molecules.

20. A method for fueling an internal combustion engine, comprising fueling said engine with the fuel composition of claim 16.

21. The composition of claim 16 further comprising II(C) a nitrogen-containing dispersant.

22. The composition of claim 21 wherein component II(C) is present at a level of about 10 to about 200 PPM based on the weight of the liquid fuel.

23. A method fueling an internal combustion engine, comprising fueling said engine with the fuel composition of claim 21.

24. A composition prepared by combining the ingredients of claim 21.

* * * * *